US010655389B2

(12) United States Patent
May et al.

(10) Patent No.: US 10,655,389 B2
(45) Date of Patent: May 19, 2020

(54) ROTARY GATE

(71) Applicant: Conduent Business Services, LLC, Dallas, TX (US)

(72) Inventors: Stephen May, Hertfordshire (GB); Colin William Robert Hewitt, Hertfordshire (GB)

(73) Assignee: CONDUENT BUSINESS SERVICES, LLC, Dallas, TX (US)

( * ) Notice: Subject to any disclaimer, the term of this patent is extended or adjusted under 35 U.S.C. 154(b) by 74 days.

(21) Appl. No.: 15/489,075

(22) Filed: Apr. 17, 2017

(65) Prior Publication Data

US 2018/0298690 A1 Oct. 18, 2018

(51) Int. Cl.

| | |
|---|---|
| ***E06B 11/08*** | (2006.01) |
| ***E06B 3/90*** | (2006.01) |
| ***G07C 9/10*** | (2020.01) |
| ***G07C 9/15*** | (2020.01) |
| *G07B 15/02* | (2011.01) |

(52) U.S. Cl.

CPC ..... *E06B 11/08* (2013.01); *E06B 3/90* (2013.01); *E06B 3/903* (2013.01); *E06B 3/906* (2013.01); *G07C 9/10* (2020.01); *G07C 9/15* (2020.01); *G07B 15/02* (2013.01)

(58) Field of Classification Search

None

See application file for complete search history.

(56) References Cited

U.S. PATENT DOCUMENTS

| | | | | |
|---|---|---|---|---|
| 3,678,623 | A * | 7/1972 | Jenkins | E06B 3/90 318/466 |
| 4,989,368 | A * | 2/1991 | Trikilis | E05D 15/02 192/81 C |
| 5,146,711 | A * | 9/1992 | Gallenschutz | E06B 11/08 49/35 |
| 5,181,018 | A * | 1/1993 | Cowie | E05G 5/003 340/5.7 |
| 7,733,043 | B2 * | 6/2010 | Casella | E05G 5/003 318/256 |
| 8,516,750 | B2 * | 8/2013 | Liles, Jr. | E05G 5/003 109/3 |
| 2005/0093697 | A1 * | 5/2005 | Nichani | G06K 9/00778 340/545.1 |
| 2006/0086894 | A1 * | 4/2006 | Shepherd | G07C 9/00 250/221 |

(Continued)

*Primary Examiner* — Marcus Menezes

(74) *Attorney, Agent, or Firm* — Fay Sharpe LLP

(57) ABSTRACT

Methods and systems are disclosed to facilitate a rotary gate controller moving from one state to another in a manner wherein the gate controller uses the state condition to determine if an exit is taking place when an entry request has been sent. Once such an occurrence is determined to exist, the MID will send an exit request allowing the exiting customer to continue through the gate. When the internal state changes to going to a home position, the MID will send a new entry request, and the MID will indicate through MID display that the entering customer can pass through the rotary gate. The original payment of the entering customer will have been accepted and will allow the entering customer to proceed through the gate. On completion of the entry rotation, the rotary gate controller will revert back to free exit and restricted entry states.

12 Claims, 7 Drawing Sheets

(56) References Cited

U.S. PATENT DOCUMENTS

| | | | | |
|---|---|---|---|---|
| 2010/0157062 | A1* | 6/2010 | Baba | G07C 9/00111 348/156 |
| 2014/0324224 | A1* | 10/2014 | Dolinshek | G05B 19/4147 700/275 |
| 2017/0228953 | A1* | 8/2017 | Lupovici | G07C 9/00309 |

* cited by examiner

ROTARY GATE

TECHNICAL FIELD

The presently disclosed embodiments are directed to rotary security gates including improved payment processing for accommodating a conflicting entry and exit occurrence.

BACKGROUND

Rotary gates 10 of the kind shown in FIG. 1 are employed to provide secured entry and exits and can be regularly seen at such venues as public transportation stations. The gate can rotate bi-directionally within the cage assembly so that when permitted to rotate in a first direction it can accommodate entry to the secured location, and when rotating in the opposite direction allows exit. Often entry is only initiated upon a payment of some kind by a customer or a patron engaging a user interface with some payment form ranging from cash, credit card, smart card or other, which is recognized as an authentic payment form to authorize entry. Typically the user interface will include a Media Information Display (MID) that will confirm acceptance of proper payment in response to a card swipe and display a state condition of the rotary gate so that the customer is informed of the gate's state and conformance with the intended operation such as entry.

A particular problem with such rotary gates, especially in heavy traffic customer locations, is that interfering and conflicting exit and entry customer actions can cause the gate to lock up against customer passage, and further may cause improper cancellation of a proper payment by an entering customer. More particularly, there is a scenario where a rotary gate entry request would cause a contemporaneous exit rotation to lock midway through the cycle resulting in the exiting customer having to back out the rotary gate to allow the paid and entering customer to enter. Worse still, this would also mean that the entry request would be canceled during the backout of the exiting customer even though the payment had been properly collected and so indicated by the MID. The entering customer has to repay to enter.

With particular reference to FIGS. 2A-2D, top planar views of the rotary gate 10 are shown in section to illustrate the problem. In FIG. 2A the exiting customer 20 is seen to be exiting the station secured by the rotary gate 10. The gate is shown in a "home position" where the bars 12 are disposed so that a metal cam flag 13 (FIG. 5) is adjacent home sensor 14 and the "home sensor is made." An entry customer 22 approaches the gate 10 (FIG. 2B) and engages the entry MID 16 with a payment card by swiping it at the entry MID. A rotary gate controller (not shown) comprising a software and hardware processor component of the MID 16 recognizes payment and sends a signal to authorize gate entry operation. However, the entry swipe has occurred at about the same time that the exiting customer 20 has already entered the cage and started to push the gate bars 12 away from the home sensor position 14, such as can be seen in FIG. 2B (Arrow 9), however the home sensor is still made. The gate is just about to enter an exit state by the action of the exiting customer as the gate has physically started to move away from the home position for an exit rotation, but importantly because the home sensor is still made, it has not yet entered the exit state. There has not yet been a signal from sensor 14 to the rotary gate controller of rotation in an exit direction by the cam flag 13 moving away from home sensor 14 and towards the direction sensor for exit rotation 18. In response to the entry customer payment swipe, the MID sends an entry request to the gate assembly thereby causing the exit solenoid and latch mechanism 60 (FIG. 6) to be energized (locked) while the entry solenoid and latch mechanism 62 is de-energized (unlocked). In FIG. 2C it can be seen that the gate is permitted to rotate a partial cycle until the bar 12 is precluded from further rotation by the exit solenoid and latch mechanism 60. The exiting customer can then only move backwards and thus will be required to move back (Arrow 7) to the exit side of the rotary gate to exit while pushing bar 11 and then allow the entering customer to enter the cage pursuant to the entry request. The entering customer 22 has to wait until the exiting customer 20 exits the cage assembly before being allowed to enter such as is shown in FIG. 2D. Unfortunately the already occurring entry rotation of the gate during the back-out of the exiting customer causes the MID to process the entry request made by the entering customer 22 and the request is then canceled by the partial entry rotation of the backing up exiting customer. The MID is unaware of this "false entry" and takes no action. The entering customer 22 who is trying to enter and has paid is now blocked from entering the rotary gate 10 and must repay at the MID in order to gain entry. The exiting customer 20 has been precluded from exiting the station and must now wait for the entering customer 22 to re-swipe the MID, push and rotate the gate to gain entry and then allow the gate to return to an exiting allowed state. In busy times with many customers at both sides of the gate such a failure in proper processing can cause significant delay and dissatisfaction to customers.

SUMMARY

According to aspects illustrated herein, there are provided methods and systems to overcome the afore-stated problems and facilitate the rotary gate controller moving from one state to another in a manner wherein the MID uses the state condition to determine if an exit is taking place when an entry request has been sent. Once such an occurrence is determined to exist, the MID will send an exit request allowing the exiting customer to continue through the gate. When the internal state changes to going to a home position, the MID will send a new entry request, and the MID will indicate through MID display that the entering customer can pass through the rotary gate. The original payment of the entering customer will have been accepted and will allow the entering customer to proceed through the gate. On completion of the entry rotation, the rotary gate controller will revert back to free exit and restricted entry states. The disclosed embodiments thus achieves a system wherein the false entries can be discounted from the total count so that there will be a better correlation between entry payments and entry counts. These correlated values can be used for fraud detection.

According to aspects illustrated herein, a rotary gate apparatus is disclosed comprising a bi-directional rotary gate and cage assembly having an exit and an entry, an entry request controller at the entry and a rotation direction sensor. The system further includes a processor for recognizing entry requests from a customer from the entry request controller and a contemporaneous rotating of the rotary gate in an exit direction from the rotation direction sensor, wherein upon a continued movement of the rotary gate to a home position in a cage via the exit direction, the entry request is enabled by permitting a rotating of the rotary gate in the entry direction and the entry of the customer through the rotary gate system.

In accordance with aspects illustrated herein, a method is provided for operating a bi-directional rotary gate and cage assembly to avoid cancellation of a first entry request and locking of the gate during exit rotation due to concurrently occurring exit rotating with the entry request. The method includes sensing with a rotation direction sensor a rotating of the gate in an exit direction while receiving the first entry request. The gate is allowed to continue to rotate in the exit direction to an exit home position for an exit by an exiting customer of the assembly. A new entry request, depending from the first entry request, is effectively enabled after the exit by the exiting customer to allow rotating of the gate in an entry direction whereby the new entry request is accepted as the first entry request.

DETAILED DESCRIPTION

Figure 1:
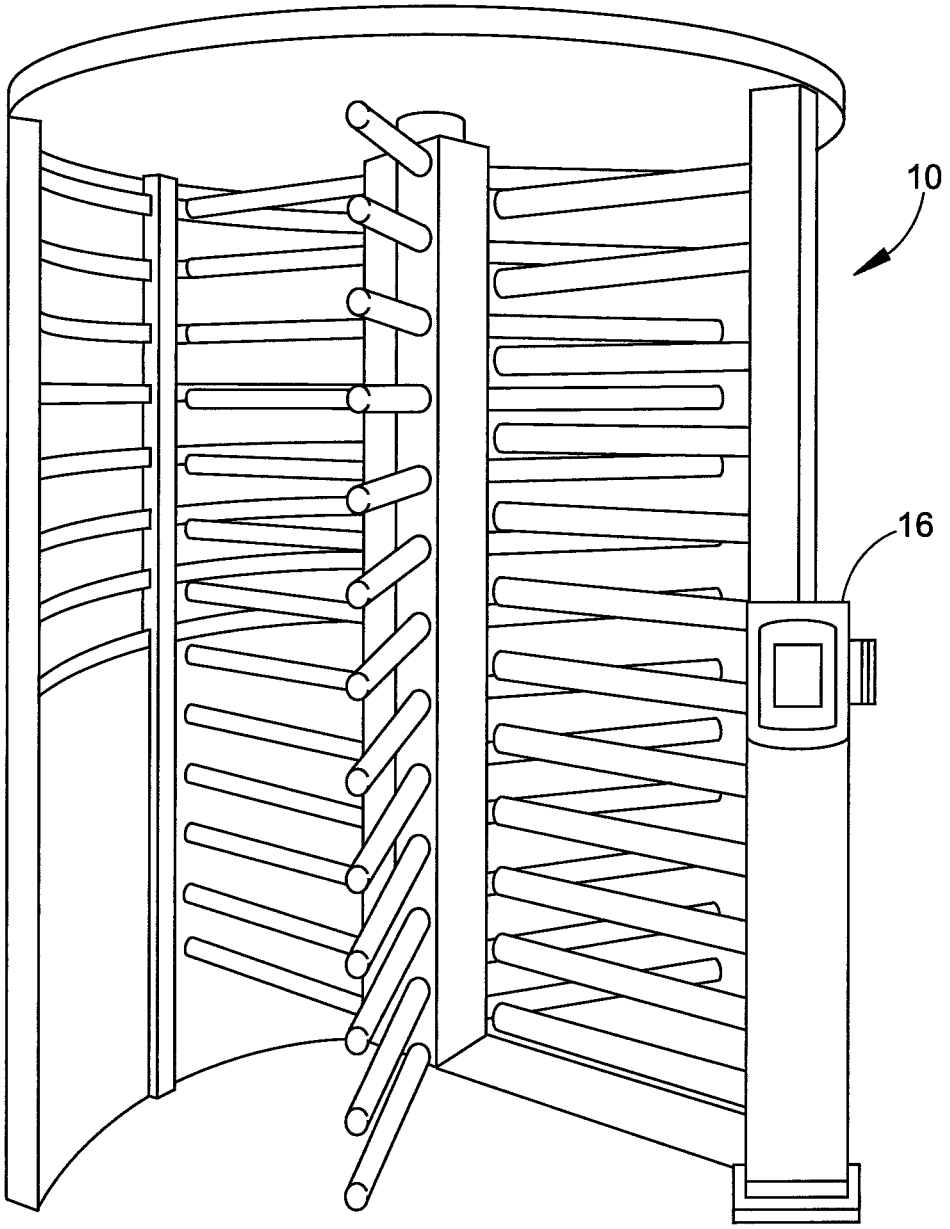
FIG. 1 is a perspective view of a bi-directional rotary gate and cage assembly.
Figure 2A:
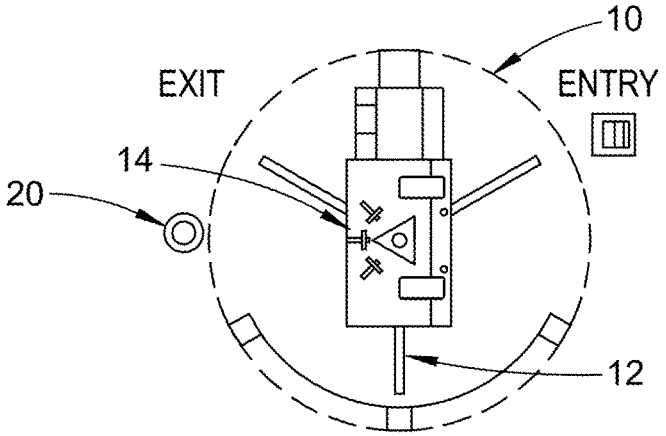
FIG. 2A (PRIOR ART)
FIGS. 2A-2D are sectional planar views of the rotary gate at selected positions within the cage assembly illustrating a prior art problem.
Figure 2B:
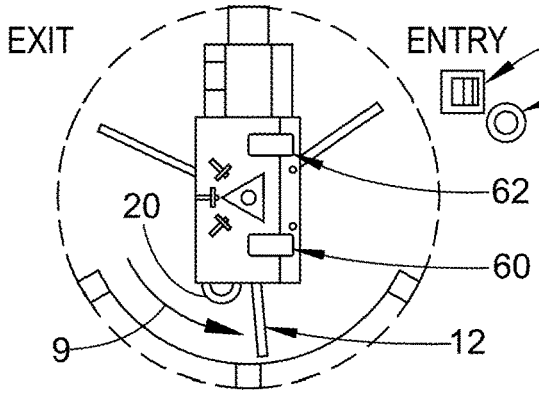
FIG. 2B (PRIOR ART)
Figure 2C:
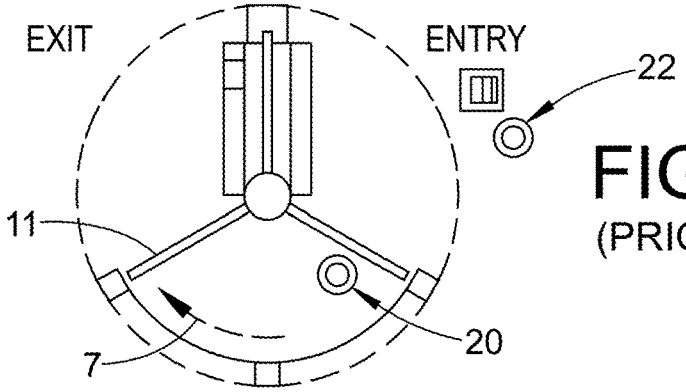
FIG. 2C (PRIOR ART)
Figure 2D:
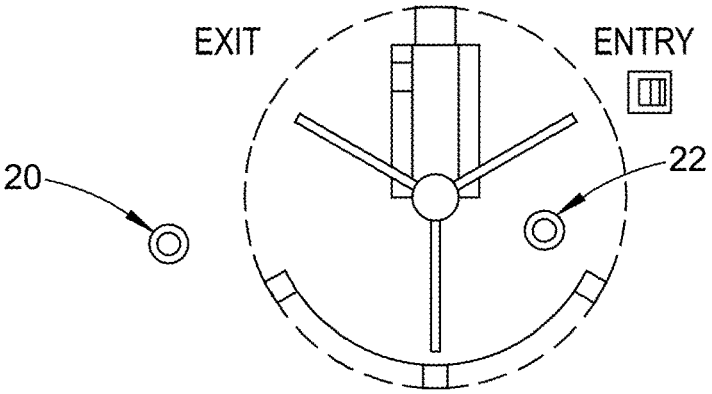
FIG. 2D (PRIOR ART)
Figure 3:
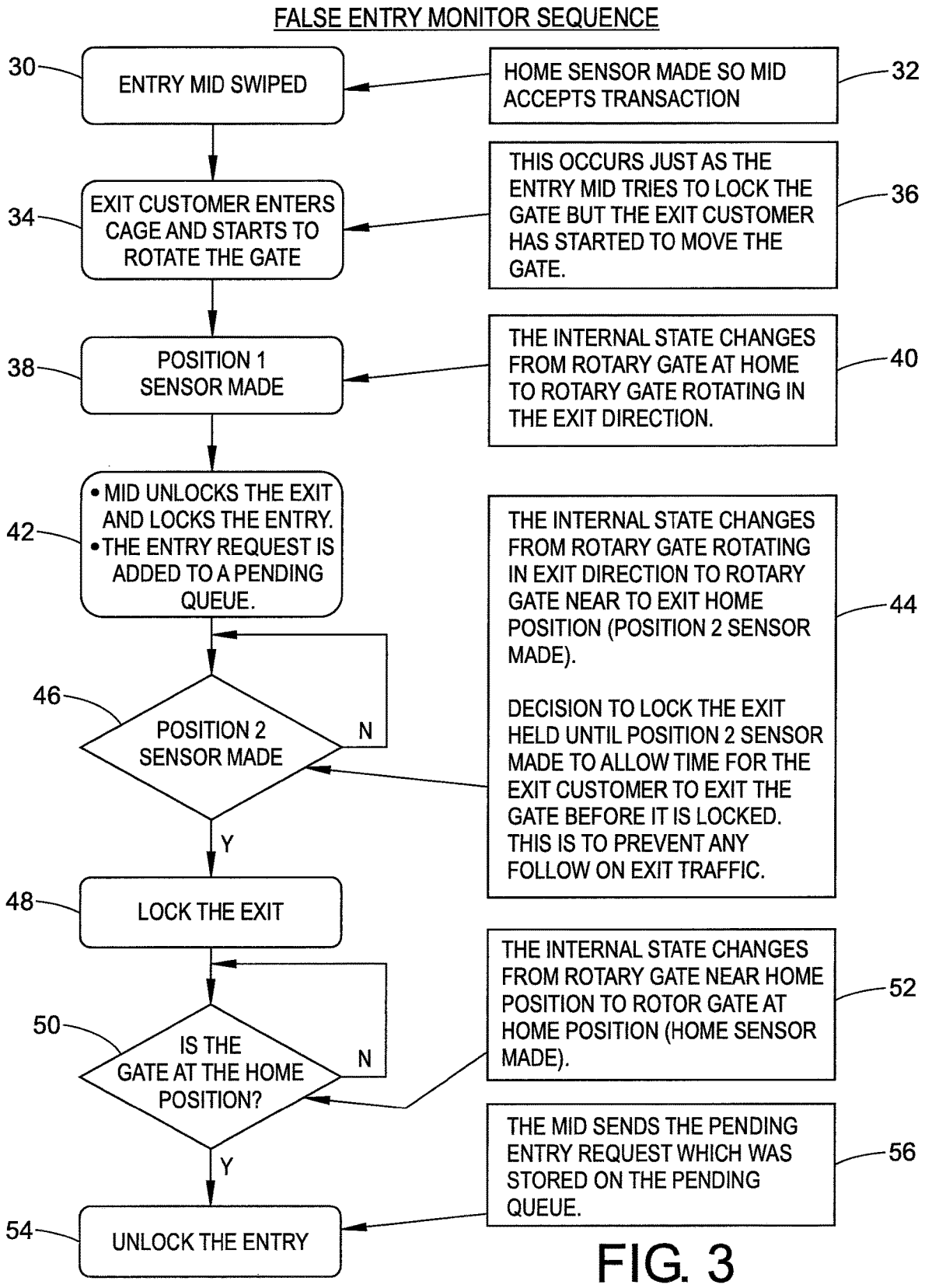
FIG. 3 is a flow chart of a disclosed embodiment comprising a false entry monitor sequence.
Figure 4A:
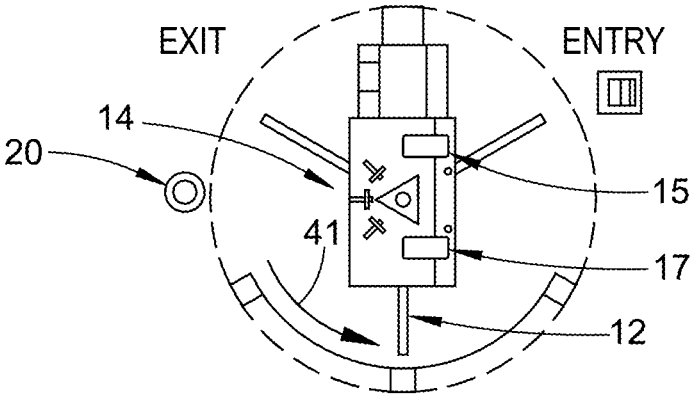
FIGS. 4A-4D are sectional planar views of select positions of the rotary gate within the cage assembly in accordance with the disclosed embodiments.
Figure 4B:
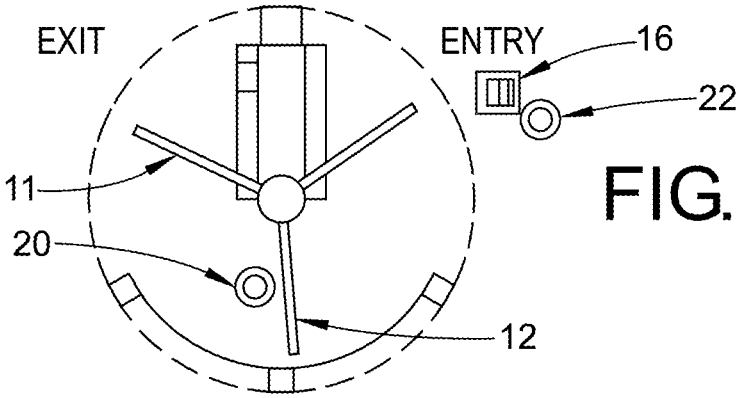
Figure 4C:
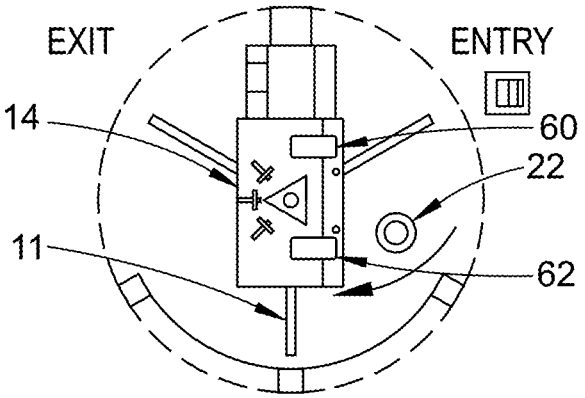
Figure 4D:
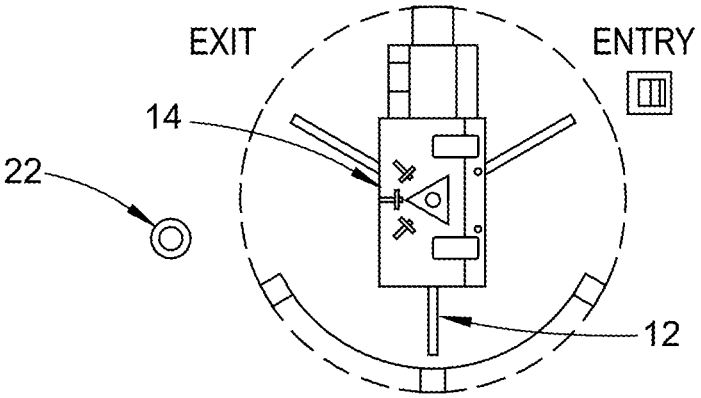
Figure 5:
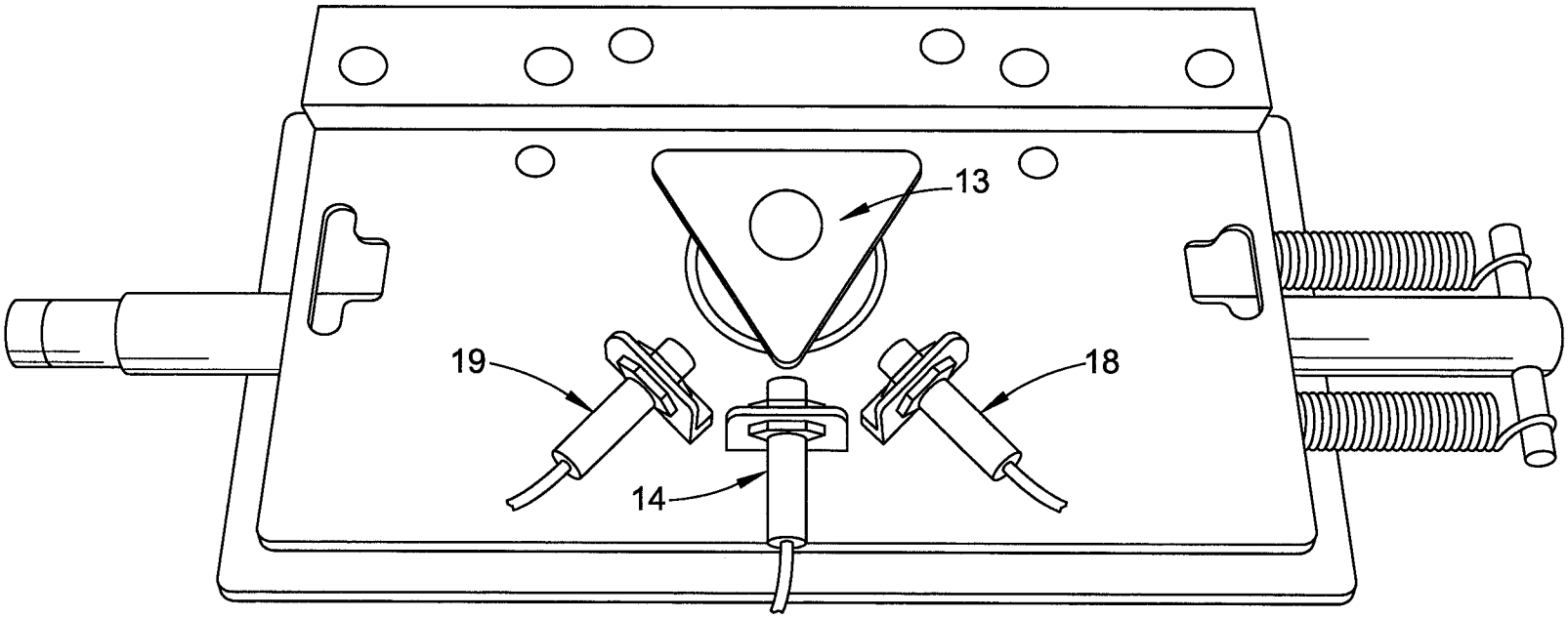
FIGS. 5 and 6 are elevated views of gate rotation locks and sensor assemblies.
Figure 6:
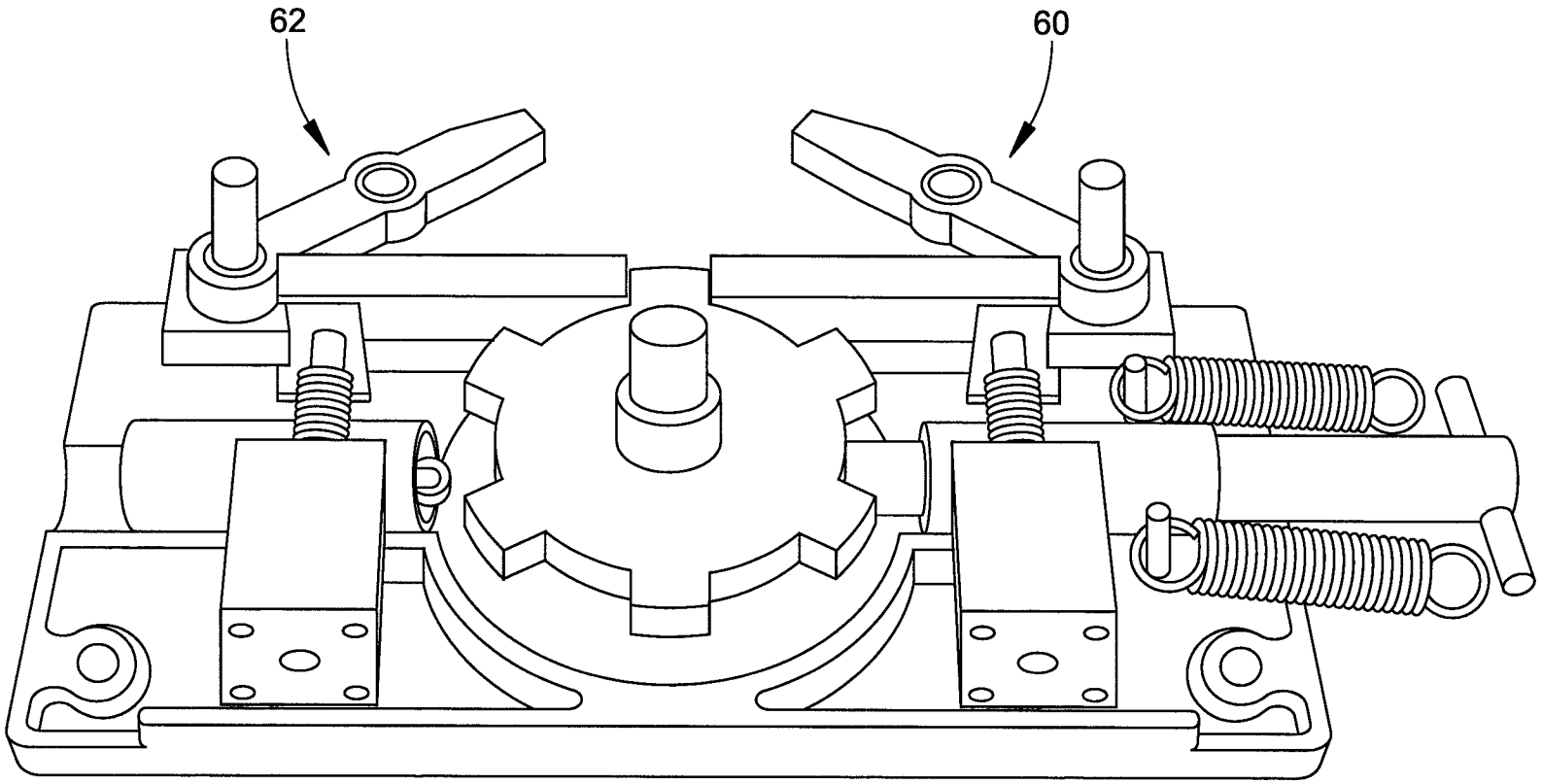

In accordance with the present embodiments, there is disclosed systems and apparatus for monitoring and handling a false entry sequence at a rotary gate and cage assembly 10. With particular reference to FIGS. 1, 3 and 4A-4D, a false entry sequence may occur when a customer 20 exiting a station secured by the gate and cage assembly 10 (FIG. 4A) approaches with the intention of passing through the cage assembly in an exit direction (Arrow 41). The gate is shown in a home position (FIG. 4A) wherein the gate is in an intermediate mode state and allows a gate rotation for free exit, but requires a payment swipe for entry at MID 16. When the gate is at the home position, the home sensor 14 is made by the positioning of the bar 12 so that cam flag 13 is adjacent to the sensor 14 as shown in FIG. 5. In FIG. 4B, entering customer 22 approaches the assembly 10 and swipes the payment card (not shown) at the MID 16 as indicated at block 30. At the time of the entry swipe, the home sensor is made 32 so the MID accepts the entry transaction. However, the exiting customer 20 has engaged the bar 12 and caused the gate to start to rotate in an exit direction 34. This occurs just as the entry MID tries to lock the gate against an exit rotation but since the exit customer has started to move the gate locking does not occur 36. In FIG. 4B, the home sensor 14 ("Position 1 home sensor made") is still made 38 and the internal state of the rotary gate controller (not shown) within the MID 16 changes from the rotary gate at home to the rotary gate rotating in an exit direction 40. The rotary gate controller 16 thus recognizes that the internal state of the rotary gate assembly is rotating in an exit direction and that an entry transaction has been accepted but has not yet occurred. The rotary gate controller of the MID then unlocks the exit solenoid and latch mechanism 60 and locks the entry solenoid and latch mechanism 62 and the entry request is added to a pending queue 42 maintained by the controller 16. The MID monitors exit direction movement of the gate via the exit direction sensor 18 recognizing the cam flag 13, and changes the state of assembly to "false entry" by sending an exit request to the processing order gate controller within the MID 16. This will allow the exit by the exit customer to be completed without interruption, FIG. 4C. At the same time the internal state of the MID changes from rotary gate rotating in an exit direction to rotary gate near to exit home position, awaiting a "Position 2 home sensor made" as also shown in FIG. 4C whereby the bar 12 has been rotated enough to allow the exiting customer 20 to leave the cage assembly and the entering customer to pass within. The controller decides to lock the entry solenoid 62 until Position 2 home sensor is made to allow time for the exiting customer to exit the gate before it is locked against an exit. This is to prevent any follow-on exit traffic 44. The controller thus waits until the Position 2 home sensor is made 46 before it locks 42 the exiting solenoid and latch mechanism 60. When the Position 2 home sensor is made, another entry request can be sent to the controller effectively as a pendency from the first entry request made in FIG. 4B as the first entry request has been queued by controller 16. This will prevent further exits and allow the previously unsuccessful first entry request to be completed. However, the exiting customer 20 must first have left the cage assembly and the entering customer 22 will have entered the cage assembly so that the rotary gate can be allowed to rotate in the entry direction shown by arrow 43. Thus before the entering customer 22 engages bar 11 to start the entry rotating of the gate, the controller must first detect if the gate is at a home position 50 via alignment of flag 13 and home sensor 14. If so the internal state changes from rotary gate near home position to rotary gate at home position (home sensor made) 52. The entry solenoid 62 is unlocked 54 by the MID sending the pending entry request which was stored in the pending queue 56. FIG. 4D shows that the entering customer 22 has exited the assembly and the gate has returned to a home position where bar 12 is aligned at the Position 1 home sensor mode location. Once there are no more entry requests in the queue the controller reverts to the intermediate mode allowing free exit rotations of the gate and awaiting another entry swipe.

Figure 7:
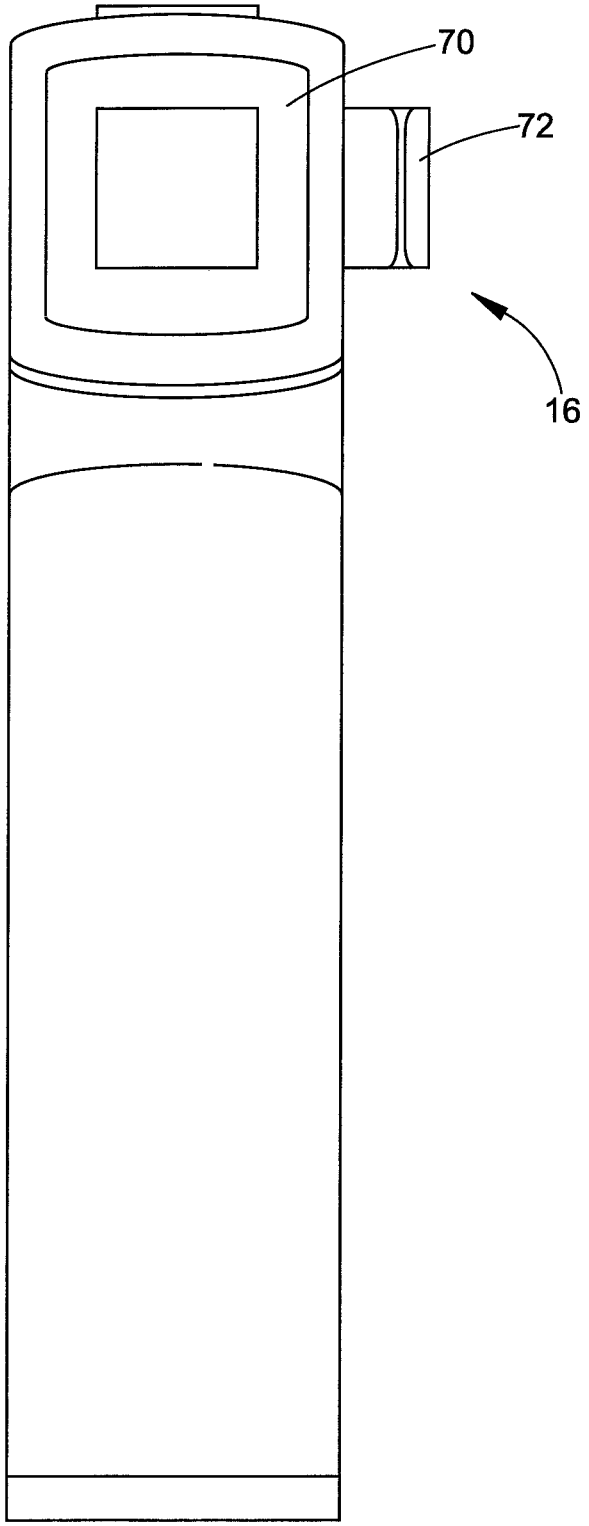
FIG. 7 is an elevated view of a Media Information Display.

With reference to FIG. 7, the MID 16 is implemented as a computer or other electronic processing device including a microprocessor, microcontroller, or other electronic processor (not shown). The illustrative computer 16 includes a display 70 and one or more user input devices such as card swipe 72 but may also include an illustrative keyboard, trackpad or other pointing device (e.g. mouse, trackball, a touch-sensitive overlay of the display 70, or so forth). The computer 16 or other device including the electronic processor is operatively connected with (e.g. includes or is connected with via a wired or wireless connection) a non-transitory storage medium (not shown) which stores instructions readable and executable by the electronic processor 16 to perform the method for gate operation in accordance with FIG. 3. The non-transitory storage medium may, for example, comprise one or more of: an internal hard disk drive of the computer 16, an external hard drive, a network-accessible hard drive or other magnetic storage medium; a solid state drive (SSD) of the computer 16 or other accessible hard drive or other magnetic storage medium; an optical disk or other optical storage medium; various combinations thereof; or so forth. The computer 16 is programmed by instructions on the non-transitory storage medium to implement the disclosed embodiments.

The foregoing embodiment has the advantage of avoiding a conflict status with the rotary gate at transportation stations when one user swipes his or her payment card to enter while another user pushes from the inside to exit. The rotary gate controller of the MID lets the rotary gate continue to rotate in an exit direction to a next home position before it is locked against exiting rotation, and then it is unlocked against movement in an entry direction upon processing of the pending entry request by the customer who has submitted the entry request and awaits the exit of the exiting customer. The result is an improvement in transportation station throughput and user satisfaction.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A rotary gate system comprising a manually powered, bidirectional rotary gate and cage assembly having a bidirectional rotary gate, a rotation direction lock, a cage, an exit and an entry, an entry request controller at the entry, and a rotation direction sensor, the system further including:

a processor for recognizing a false entry sequence comprising an entry request from a first customer including an accepted entry payment transaction from the entry request controller whereby a lock against exit direction rotation is initiated, and for recognizing a contemporaneous rotating of the rotary gate moving in an exit direction from a first home position by a second customer by the rotation direction sensor by a manual pushing of the rotary gate by the second customer to cause the moving in the exit direction comprising the false entry sequence whereby the lock against exit direction rotation is precluded, wherein upon reading a second home position of the rotary gate after a continued movement of the rotary gate from the first home position in the cage in the exit direction by the second customer, the entry request is then enabled.

2. The system of claim 1 wherein the contemporaneous rotating further comprises a detecting by the rotation direction sensor of the rotary gate at the second home position.

3. The system of claim 2 further including the rotation direction lock to preclude the gate rotating from the detected first home position in an entry direction absent a customer entry request.

4. The system of claim 3 wherein the gate rotation lock enables the gate rotating in the exit direction from the first home position during the recognizing of the contemporaneous customer entry request.

5. The system of claim 1 wherein upon the contemporaneous rotating of the rotary gate to the second home position, a subsequent rotating of the rotary gate in the exit direction is precluded until after the rotating of the rotary gate in the entry direction is completed for the enabled first customer entry request.

6. The system of claim 1 wherein the processor includes a media information display recognizing an entry state condition and an exit state condition.

7. A method for operating bidirectional rotary gate and cage assembly of claim to avoid cancellation of the entry request and locking of the gate during the exit rotation due to concurrently occurring exit rotating with the entry request, comprising:

sensing with the rotation direction sensor a rotating of the gate in the exit direction while receiving the entry request;

allowing the gate to continue to rotate in the exit direction to the first home position for the exit by the second customer of the assembly; and enabling the entry request after the exit by the second customer and allowing rotating of the gate in an entry direction whereby the entry request is accepted as a first entry request.

8. The method of claim 7 wherein the first entry request is processed by a media information display recognizing an entry state condition and an exit state condition and the sensing of the rotating in the exit direction further includes sensing that the rotary gate is at an entry home position in the cage assembly.

9. The method of claim 8 wherein the assembly includes a rotary gate controller and upon the sensing the rotating in the exit direction while receiving the first entry request, the rotary gate controller moves to the exit state condition for the allowing of the gate to continue to rotate in the exit direction.

10. The method of claim 9 wherein the rotary gate controller moves to the entry state condition for allowing rotating of the gate in the entry direction upon a sensing of the gate at the exit home position.

11. The system of claim 1 wherein the processor adds the accepted entry payment transaction to a pending queue during the movement of the rotary gate in the exit direction.

12. The system of claim 11 wherein upon the reading of the gate at the second home position, the gate is locked against further rotating in an exit direction, and the entry request is enabled.

* * * * *